US011168880B2

(12) United States Patent
Hou et al.

(10) Patent No.: US 11,168,880 B2
(45) Date of Patent: Nov. 9, 2021

(54) CABINET LIGHT INCLUDING HEAT DISSIPATION STRUCTURE AND QUICK WIRING STRUCTURE USED FOR PIERCING INSULATION LAYERS OF WIRES

(71) Applicant: XIAMEN LEEDARSON LIGHTING CO., LTD, Fujian (CN)

(72) Inventors: Shouqiang Hou, Fujian (CN); Xiaoliang Wen, Fujian (CN); Zhenkun Huang, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 17/000,194

(22) Filed: Aug. 21, 2020

(65) Prior Publication Data

US 2021/0088208 A1 Mar. 25, 2021

(30) Foreign Application Priority Data

Sep. 23, 2019 (CN) ..... 201921587167.7
Sep. 23, 2019 (CN) ..... 201921588891.1
Sep. 23, 2019 (CN) ..... 201921589021.6

(51) Int. Cl.
*F21V 21/002* (2006.01)
*F21V 29/80* (2015.01)
*F21V 29/506* (2015.01)
*F21W 131/301* (2006.01)

(52) U.S. Cl.
CPC ..... *F21V 29/80* (2015.01); *F21V 21/002* (2013.01); *F21V 29/506* (2015.01); *F21W 2131/301* (2013.01)

(58) Field of Classification Search
CPC ..... F21V 15/01; F21V 15/013; F21V 29/506; F21V 29/80; F21V 23/009; F21V 21/002; F21W 2131/301; F21Y 2105/10; F21S 4/28
See application file for complete search history.

(56) References Cited

U.S. PATENT DOCUMENTS 5,658,067 A * 8/1997 Engle ..... F21S 2/00 362/219
6,536,924 B2 * 3/2003 Segretto ..... F21S 4/28 362/345
2005/0141219 A1 * 6/2005 Skegin ..... F21S 4/28 362/240

(Continued)

*Primary Examiner* — Zheng Song
(74) *Attorney, Agent, or Firm* — Chun-Ming Shih; Lanway IPR Services

(57) ABSTRACT

A cabinet light includes a heat dissipation shell; a light emitting component disposed in the heat dissipation shell; a driving component disposed in the heat dissipation shell and electrically connected to the light emitting component; a sealing end cover disposed on an open at a side of the heat dissipation shell by insertion and comprising a cavity; a cover element detachably disposed on an open at a top of the heat dissipation shell and comprising a light transmission area for light to pass through; a fixing structure disposed between the sealing end cover and the cover element; a piercing conductor disposed in the cavity and configured to pierce insulation layers of wires wherein the wires are placed in the cavity; and a press element disposed on a mouth of the cavity and configured to press the piercing conductor.

14 Claims, 8 Drawing Sheets

(56) References Cited

U.S. PATENT DOCUMENTS

| | | | | |
|---|---|---|---|---|
| 2007/0165396 | A1* | 7/2007 | Cunius | F21V 21/002 362/127 |
| 2008/0030983 | A1* | 2/2008 | Pickett | F21V 33/0012 362/222 |
| 2013/0027936 | A1* | 1/2013 | Ladewig | F21S 2/005 362/249.01 |
| 2015/0345754 | A1* | 12/2015 | Sohn | F21S 4/008 362/222 |
| 2017/0307145 | A1* | 10/2017 | Hollander | F21V 5/02 |
| 2020/0072456 | A1* | 3/2020 | Vasguez | F21V 15/01 |

* cited by examiner

CABINET LIGHT INCLUDING HEAT DISSIPATION STRUCTURE AND QUICK WIRING STRUCTURE USED FOR PIERCING INSULATION LAYERS OF WIRES

FIELD

The disclosure is related to a cabinet light, and more particularly, a cabinet light including a heat dissipation structure and a quick wiring structure used for piercing insulation layers of wires.

BACKGROUND

With the applications of LED (light-emitting diode) lamp increases, high-power and high-brightness LED chips have been developed. In recent years, since high-power and high-brightness LED chips have been well developed and the lighting efficiency has been continuously improved, more and more high-power and high brightness LED products are introduced in the field of lighting. As an important type of LED lamps, LED cabinet lights are widely used for cabinet lighting. At present, regarding the existing cabinet lights on the market, when it is necessary to connect multiple cabinet lights, a male terminal and a female terminal are connected to two ends of a wire to be inserted to two ends of a main lamp for realizing the connection of multiple cabinet lights. However, this method leads to difficulties of adjusting the length of the wire between two cabinet lights and inconvenience of installing cabinet lights. Moreover, heat dissipation problem leads to aging problem of components of a cabinet light.

SUMMARY

An embodiment provides a cabinet light including a heat dissipation shell; a light emitting component disposed in the heat dissipation shell; a driving component disposed in the heat dissipation shell and electrically connected to the light emitting component; a sealing end cover disposed on an open at a side of the heat dissipation shell by insertion and comprising a cavity; a cover element detachably disposed on an open at a top of the heat dissipation shell and comprising a light transmission area for light to pass through; a fixing structure disposed between the sealing end cover and the cover element; a piercing conductor disposed in the cavity and configured to pierce insulation layers of wires wherein the wires are placed in the cavity; and a press element disposed on a mouth of the cavity and configured to press the piercing conductor.

Another embodiment provides a quick wiring structure including an installation element; a cavity located on the installation element and configured to place wires; a plurality of piercing conductors disposed in the cavity and configured to pierce insulation layers of the wires; and a press element detachably disposed on a mouth of the cavity and configured to press the piercing conductors; wherein when the press element is disposed on the mouth of the cavity, the press element presses the piercing conductors, the piercing conductors squeeze an outside of the wires so as to pierce through the insulation layers of the wires, and the piercing conductors are electrically connected to the wires.

Another embodiment provides a heat dissipation structure including a heat dissipation shell connected to a light emitting component; a sealing end cover disposed on an open of a side of the heat dissipation shell; and a heat dissipation partition disposed in the heat dissipation shell and configured to partition the heat dissipation shell into a heat dissipation cavity and a lighting cavity; wherein a driving component is disposed in the heat dissipation cavity, the light emitting component is disposed in the lighting cavity, a heat dissipation covering board is disposed on a mouth of the heat dissipation cavity, and a light transmission element is disposed on a mouth of the lighting cavity for light to pass through.

DETAILED DESCRIPTION

Figure 1:
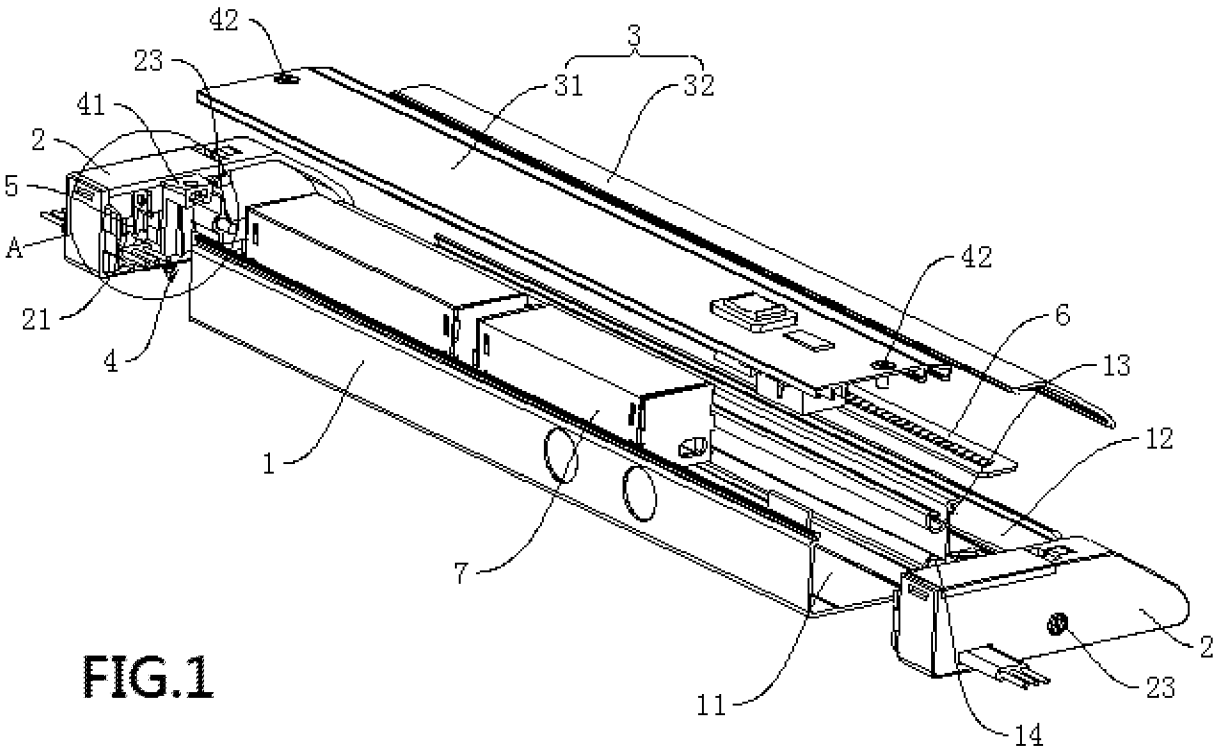
FIG. 1 to FIG. 3 respectively illustrate a part of a cabinet light according embodiments.

Below, exemplary embodiments will be described in detail with reference to accompanying drawings so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

Figure 2:
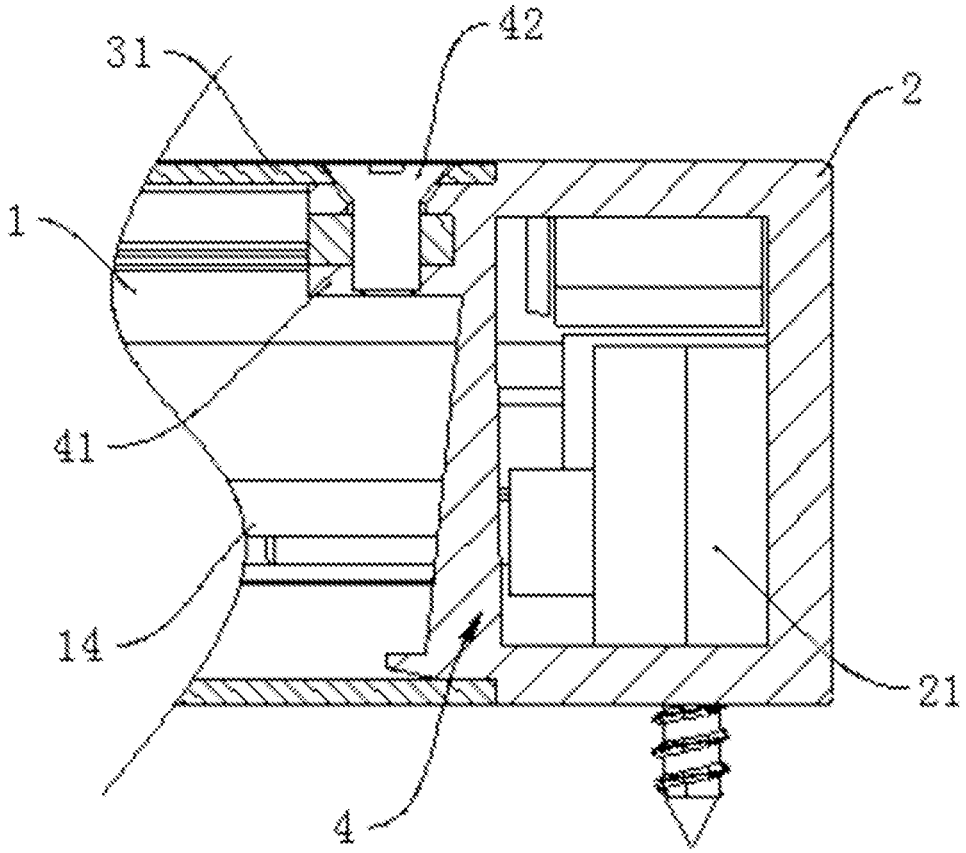
Figure 3:
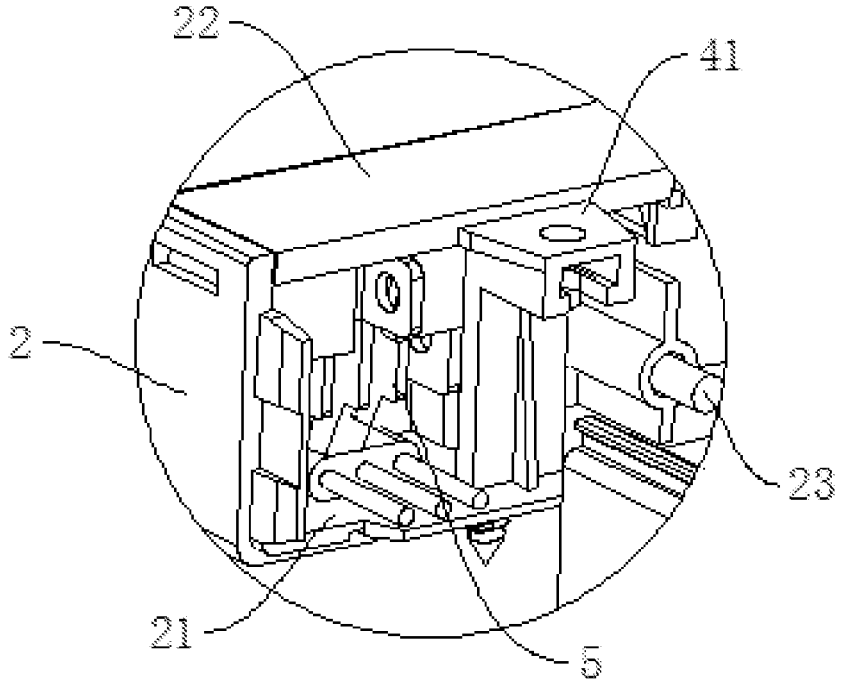
Figure 4:
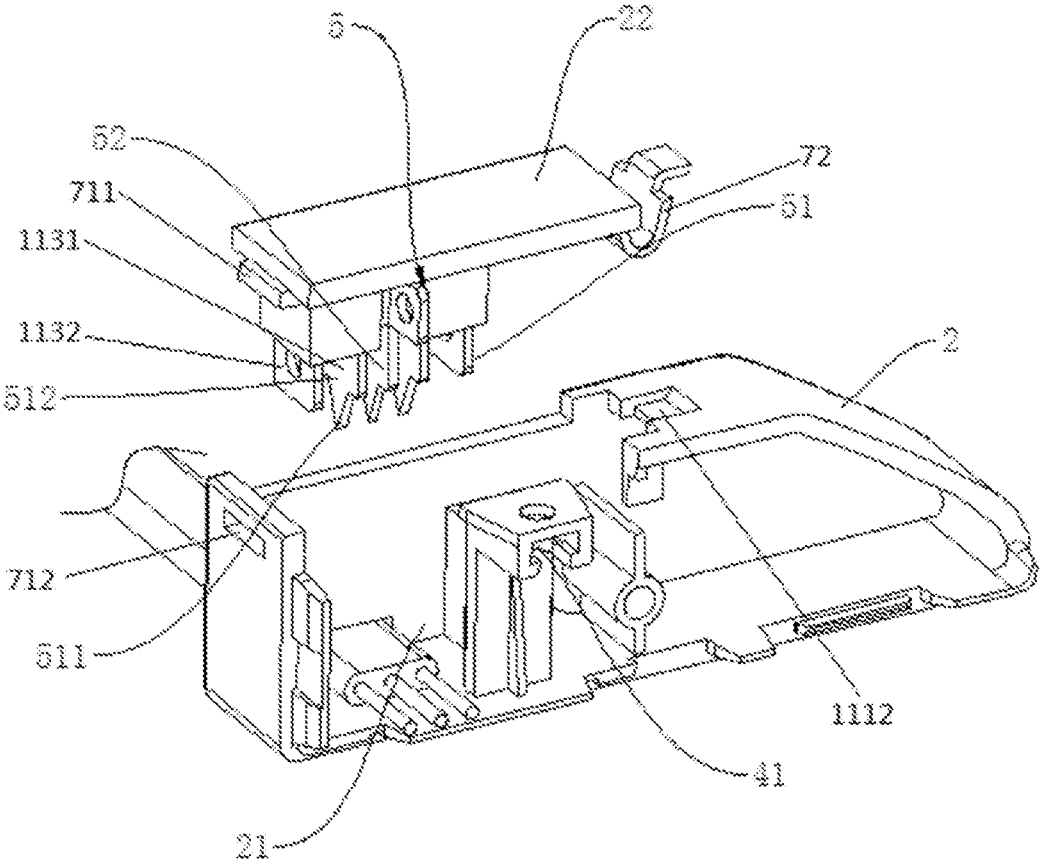
FIG. 4 and FIG. 5 illustrate a quick wiring structure used in a cabinet light according to embodiments.
Figure 5:
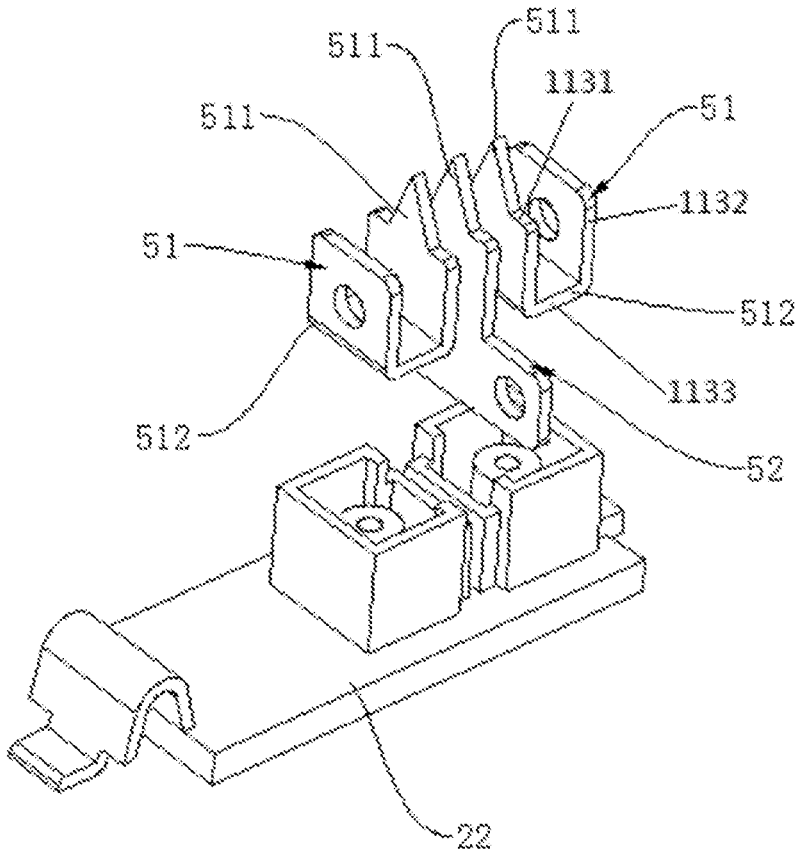
Figure 6:
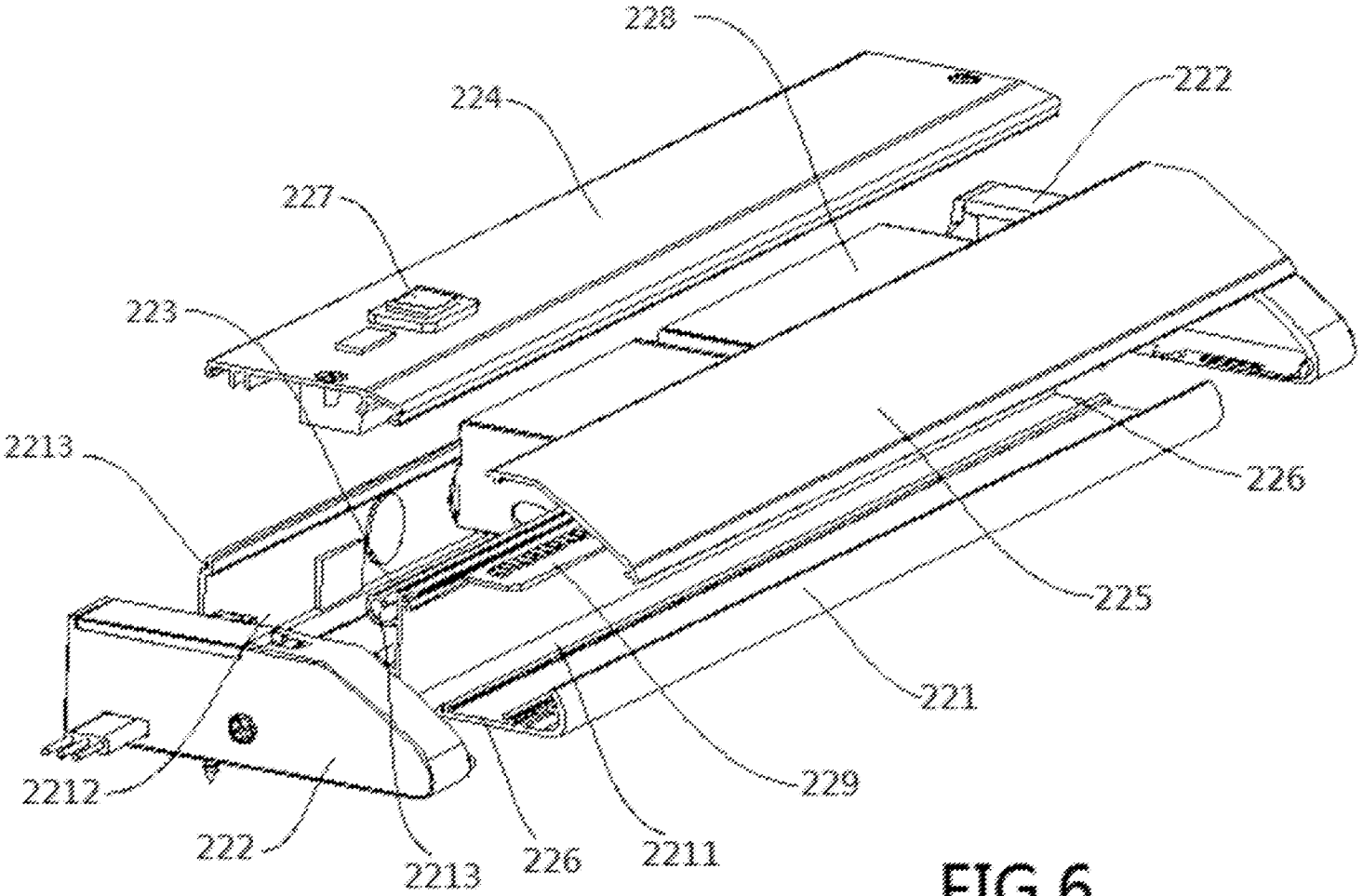
FIG. 6 to FIG. 8 illustrate a heat dissipation structure according to embodiments.
Figure 7:
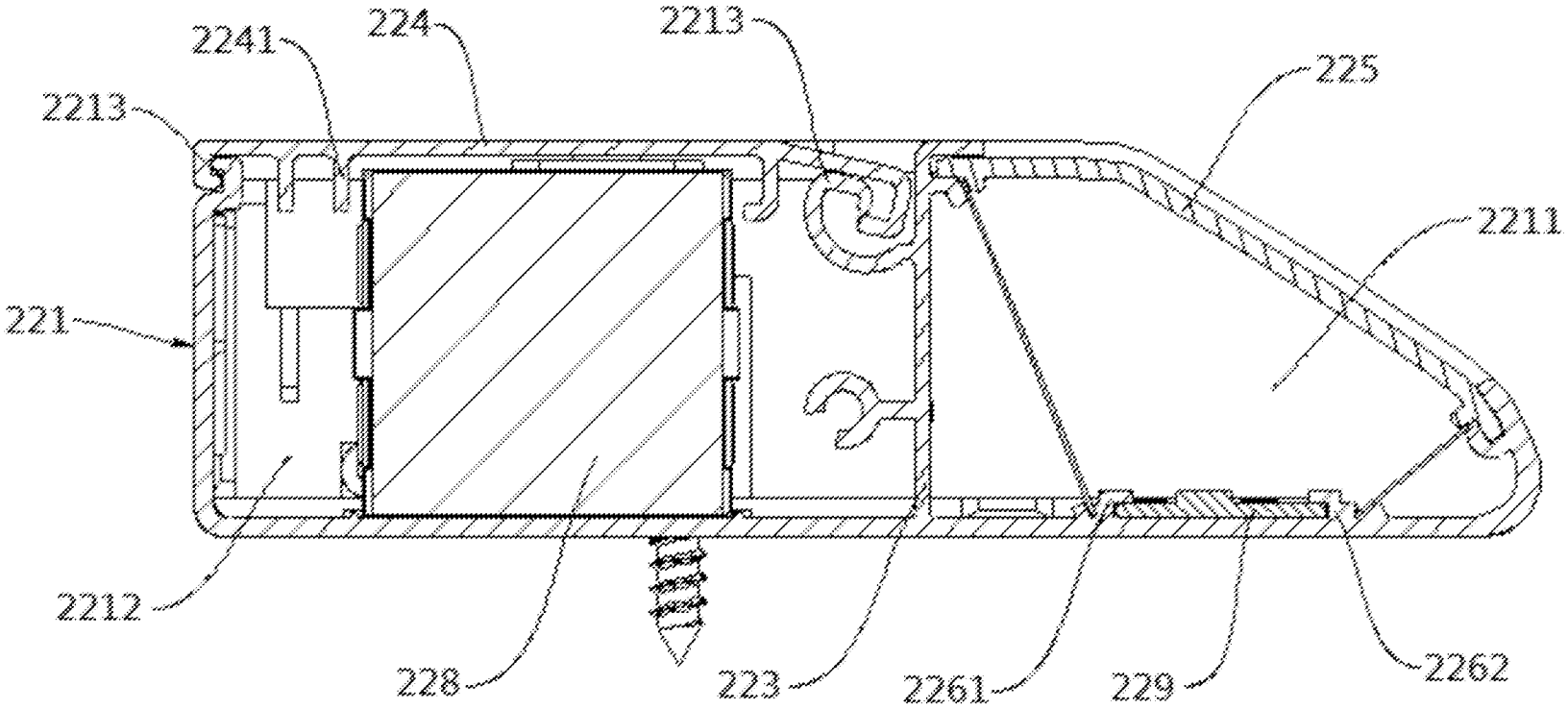

FIG. 1 to FIG. 3 respectively illustrate a part of a cabinet light according embodiments. FIG. 4 and FIG. 5 illustrate a quick wiring structure used in a cabinet light according to embodiments. FIG. 6 and FIG. 7 illustrate a heat dissipation structure according to embodiments.

As shown in FIG. 1 and FIG. 4, the cabinet light may include a heat dissipation shell 1; a light emitting component 6 disposed in the heat dissipation shell 1; a driving component 7 disposed in the heat dissipation shell 1 and electrically connected to the light emitting component 6; a sealing end cover 2 disposed on an open at one of two sides of the heat dissipation shell 1 by insertion; a cover element 3 detachably disposed on an open at a top of the heat dissipation shell 1; and a fixing structure 4 disposed between the sealing end cover 2 and the cover element 3. A light transmission area is on the cover element 3 for light to pass through. The sealing end cover 2 has a cavity 21 for placing wires. A piercing conductor 5 is disposed in the cavity 21 and configured to pierce insulation layers of wires. A press element 22 is disposed on a mouth of the cavity 21 and configured to press the piercing conductor 5. When the press element 22 is installed to the mouth of the cavity 21, the press element 22 may press the piercing conductor 5 to squeeze the outside of the wires to pierce through the insulation layers of wires, and the piercing conductor 5 may be electrically connected with the metal line in the wires.

In a cabinet light provided by an embodiment, the sealing end cover 2 is disposed on an open at one of two sides of the heat dissipation shell 1 by insertion. The cover element 3 is detachably disposed on an open at the top of the heat dissipation shell 1. The fixing structure 4 is disposed between the sealing end cover 2 and the cover element 3. The cavity 21 is at each of two sides of the fixed light holder for placing wires. The piercing conductor 5 and the press element 22 are disposed in the cavity 21. By means of the structures shown in FIG. 1 and FIG. 4, the efficiency of assembling and producing cabinet lights may be improved. When two cabinet lights are connected, the wires may be placed into the cavity 21, and the press element 22 may be pressed to press the piercing conductor 4, and the wires may be connected and installed. The lengths and locations of the wires placed in the cavity 21 may be conveniently adjusted, so the lights may be connected more conveniently.

Regarding FIG. 2 and FIG. 4, the piercing conductor 5 may include two side piercing elements 51 and at least one middle piercing sheet 52 disposed between the two side piercing elements 51. The side piercing elements 51 and the middle piercing sheet 52 are fixed on the press element 22 close to a side of the sealing end cover 2. On the press element 22, a installation structure is further disposed for installing the piercing conductor 5. The piercing conductor 5 includes the two side piercing elements 51 and the at least one middle piercing sheet 52. The number of the middle piercing sheet 52 may be adjusted according to the number of metal lines in the wires. The middle piercing sheet 52 may be arranged at interval to reduce the distance between the two side piercing elements 51. The side piercing elements 51 and the middle piercing sheet 52 may be placed closer without contacting one another, and the occupied space is reduced. The side piercing elements 51 and the middle piercing sheet 52 are fixed on the press element 22 to make the installation more firmly. It may be avoided that the side piercing elements 51 and the middle piercing sheet 52 split away from the cavity 21. The piercing conductor 5 may pierce the wires more precisely.

As shown in FIG. 4 to FIG. 5, the side piercing element 51 may have a piercing tip 511 and an installation part 512. The piercing tip 511 is disposed on the press element 22 and used to pierce the insulation layers of the wires, and the installation part 512 is used to fix the piercing tip 511 on the press element 22 close to a side of the sealing end cover 2. By means of this structure, the side piercing element 51 may pierce the insulation layers for conduction and it is convenient to fix the side piercing element 51 on the press element 22. Hence, the side piercing element 51 may be more usable.

The middle piercing sheet 52 may include the piercing tip 511 for piercing through the insulation layers of the wires, the installation sheet for fixing the piercing tip 511 on the press element 22, and the wiring sheet for electrically connecting the middle piercing sheet 52 with the driving component 7. The piercing tip 511 and the middle piercing sheet 52 may be on a same plane. With this structure, the two side piercing elements 51 and the middle piercing sheet 52 may be placed closer without contacting one another, and the occupied space is reduced.

As shown in FIG. 4 and FIG. 5, the installation part 512 may have an installation sheet 1131, a wiring sheet 1132 and a connection sheet 1133. The installation sheet 1131 is fixed and connected with the piercing tip 511. The wiring sheet 1132 is at a side of the installation sheet and used to electrically connect the piercing element 5 with the driving component 7. The connection sheet 1133 is disposed between the installation sheet and the wiring sheet. The fixing structure 4 is disposed on the wiring sheet for fixing the installation sheet on the press element 22. The installation sheet 1131, the wiring sheet 1132 and the connection sheet 1133 may form a U-shape structure. By fixing the connection sheet 1133 onto the press element 22, the installation part 512 may be conveniently fixed with the press element 22. Optionally, the installation sheet 1131, the wiring sheet 1132 and the connection sheet 1133 may be formed integrally to be a one-pieced structure and be made by bending one piece of metal. The fixing structure 4 may have a hole for a screw to pass through, and a tapped hole may be formed on a corresponding location on the press element 22 so as to install the installation part 512 more easily.

According to an embodiment, the piercing top 511 may have a triangular shape with a side disposed on a side of the installation sheet and a vertex used to pierce the wire when the side piercing element 1 or the middle piercing sheet 52 is pressed by the pressure from the press element 22. Optionally, the wiring sheet may have a wiring hole for the side piercing elements 51 and the middle piercing sheet 52 to be connected with the driving component 7 of the light, and the side piercing element 51 may be used more conveniently. Further, the wiring sheet and the wire coupled to the driving component 7 may be welded to make the connection stronger.

According to an embodiment, as shown in FIG. 4 to FIG. 5, the fixing structure 4 may include an installation bracket 41 and a first lock element 42. The installation bracket 41 is disposed at a side of the sealing end cover 2. The first lock element 42 is disposed between the installation bracket 41 and the cover element 3. An installation surface is on the installation bracket 41 for mounting the first lock element 42. After installing the sealing end cover 2, the installation bracket 41 disposed at the side of the sealing end cover 2 may be inserted into the heat dissipation shell 1, and the installation surface may be placed on the surface of the cover element 3. The connection between the installation bracket 41 and the cover element 3 may be realized, and it may be easier to firmly fix the sealing end cover 2.

According to an embodiment, the installation bracket 41 may have a support sheet, a support block and a enhancing board. The support sheet is disposed on a side of the sealing end cover 2. The support block may be disposed on the support sheet and close to an end of the cover element 3 so as to protrude from the side of sealing end cover 2. The enhancing board may be disposed between the support sheet and the support block. The installation surface may be on the support block. The first lock element 42 may fix the cover element 3 on the support block to improve the robustness of the installation bracket 41.

According to an embodiment, as shown in FIG. 1 and FIG. 2, the first lock element 42 may include a connection rod and a press cap. The connection rod may pass through the cover element 3 and have a terminal detachably connected to the installation bracket 41. The press cap may be connected to another terminal of the connection rod and be used to press and fix the cover element 3. One terminal of the connection rod is disposed on the installation bracket 41, and the press cap on another terminal of the connection rod is used to press the cover element 3 to fix the cover element 3 on the installation surface. On a surface of the cover element 3, there are a passing hole for the connection rod to pass through and a containing groove for placing the press cap. The first lock element 42 has this structure for the cover element 3 to be fixed more easily, and the containing groove may be used for the surface of the cover element 3 to be more flat after being installed.

According to an embodiment, as shown in FIG. 1 and FIG. 2, a support partition 13 is disposed in the heat dissipation shell 1 and used to partition the heat dissipation shell 1 into a first cavity 11 and a second cavity 12. The driving component 7 is disposed in the first cavity 11, and the light emitting component 6 is disposed in the second cavity 12. The heat energy generated by the driving component 7 in the first cavity 11 may be prevented from entering the second cavity 12. Hence, the heat dissipation of the light emitting component 6 may be not affected. Moreover, the support partition 13 may increase the area of the heat dissipation shell 1 contacting the air, and the first cavity 11 may help the second cavity 12 to dissipate heat, so the heat dissipation of the heat dissipation shell 1 may be improved.

According to an embodiment, as shown in FIG. 1 and FIG. 2, a fixing groove 14 is disposed on the support partition 13 for fixing the sealing end cover 2. A second lock element 23 is disposed on the sealing end cover 2 for fixing the sealing end cover 2 in the fixing groove 14. The second lock element 23 may pass through the sealing end cover 2 and be detachably inserted into the fixing groove 14. The fixing groove 14 and the second lock element 23 may make the fixing between the sealing end cover 2 and the heat dissipation shell 1 stronger. The second lock element 23 may use a fastening screw and be screwed with the fixing groove 14.

According to an embodiment, the fixing groove 14 is a pillar structure having a circular cross section, and the fixing groove 14 has an open along a long side of the fixing groove 14. The second lock element 23 and the fixing groove 14 are disposed according to a same axis. A terminal of the second lock element 23 is placed deep into the fixing groove 14. The fixing groove 14 and the second lock element 23 are screwed with one another. By means of this structure of the fixing groove 14, there may be some safe space when the second lock element 23 is installed into the fixing groove 14, and the second lock element 23 is prevented from breaking the fixing groove 14.

According to an embodiment, as shown in FIG. 1, the cover element 3 may have a separable structure including a heat dissipation board 31 disposed to cover a mouth of the first cavity 11, and a light transmission board 32 disposed to cover a mouth of the second cavity 12. A light transmission area may be on the light transmission board 32 to be a part of the light transmission board 32 or cover all area of the light transmission board 32. At the mouth of the first cavity 11, there is a snap groove used to install the heat dissipation board 31. The heat dissipation board 31 may be generated using a metal material. The two sides of the heat dissipation board 31 may be tightly abutted on the two sides of the mouth of the first cavity 11. The heat dissipation board 31 may increase the area of the heat dissipation shell 1 which contacts the air so as to improve the heat dissipation. At the mouth of the second cavity 12, there is a sliding groove for inserting and fixing the light transmission board 32. The sliding groove is located at the two sides of the mouth of the second cavity 12. The two sides of the light transmission board 32 may be slid into the sliding groove. After the light transmission board 32 is inserted and fixed into the sliding groove, the two sealing end covers 2 may be used to clamp and fix the light transmission board 32 inside the sliding groove.

According to an embodiment, as shown in FIG. 1 and FIG. 2, the heat dissipation board 31 may be slid to be snapped at the mouth of the first cavity 11. There are fixing grooves at a side wall of the heat dissipation shell 1 and a side of the support partition 13 for fixing the heat dissipation board 31. The heat dissipation board 31 may seal the mouth of the first cavity 11 to better protect the driving component 7 in the first cavity 11. The heat dissipation board 31 may be snapped at the mouth of the first cavity 11, and the two sides of the heat dissipation board 31 may be fixed with the heat dissipation shell 1 using the fixing grooves. There may be heat conduction between the heat dissipation board 31 and the heat dissipation shell 1. The heat dissipation board 31 may increase the contact area of the first cavity 11 with the air.

According to an embodiment, the number of the fixing grooves may be two. The two fixing grooves may be respectively at the side of the support partition 13 and the side wall of the first cavity 11 (i.e. the side wall of the heat dissipation shell 1). The opens of the two fixing grooves may be of the same direction. The two fixing grooves and the heat dissipation shell 1 may be of a one-pieced structure. The heat dissipation board 31 may have two fixing hooks corresponding to the two fixing grooves for being fixed. The structure with the fixing grooves and the fixing hooks may fix the heat dissipation board 31 more firmly. The two sides of the heat dissipation board 31 may contact the heat dissipation shell 1 closer to improve the heat dissipation.

According to an embodiment, as shown in FIG. 1, the support partition 13 and the heat dissipation shell 1 are of an one-pieced structure, so the heat conduction between the support partition 13 and the heat dissipation shell 1 may be improved. The fixing grooves 14 is on the support partition 13 to form a one-pieced structure, so the fixing grooves 14 and the support partition 13 may be connected more firmly. The heat dissipation shell 1 may be generated using high conductive material such as aluminum. The support partition 13 and the fixing grooves 14 may be structures on the heat dissipation shell 1.

In FIG. 4, the cavity 21 may optionally have a wiring hole for the wires to pass through. The wires may also be extended deep in the cavity 21 from the mouth of the cavity 21.

According to an embodiment, as shown in FIG. 4 and FIG. 5, the buckle structure 117 includes a connection part for fixing an end of the press element 22 to the sealing end cover 2; and a flexible buckle for fixing another end of the press element 22 to the sealing end cover 2. When installing the press element 22, the connection part can be placed to connect a first end of the press element 22 to the sealing end cover 2; then, the press element 2 may be rotated and pressed for the piercing through the insulation layers of the wires; and then, the flexible buckle can be fixed to a second end of the press element 22 to the sealing end cover 2. The piercing conductor 5 may be kept contacting the wires.

Optionally, as shown in FIG. 4 to FIG. 5, the flexible buckle 72 may include a fixing board connecting to the press element 22 and a flexible part. The sealing end cover 2 may have a slot for the flexible part to pass through and a groove 1112 for placing the fixing board. When the press element 22 is installed, the fixing board may be pushed, the flexible part may be deformed, and the fixing board may be placed in the groove 1112. The fixing board may be released, and the fixing board may be fixed in the groove 1112 for the flexibility of the flexible part. The press element 22 may be firmly fixed. The flexible buckle 72 may have this structure for the press element 12 to be installed more easily. Optionally, the flexible part may be a U-type flexible sheet disposed between the fixing board and the press element 22.

According to an embodiment, as show in FIG. 4 to FIG. 5, an insertion board 711 may be disposed on a side of the press element 22. An insertion slot 712 may be formed on the sealing end cover 2. When the press element 22 is installed, the insertion board 711 may be inserted into the insertion slot 712; the flexible buckle 72 may be pushed for the press element 22 to move toward the insertion slot 712; and then the flexible buckle 72 may cooperate to firmly fix the press element 22. By means of the abovementioned structure, the press element 2 can be installed more easily.

FIG. 6 and FIG. 7 illustrate a heat dissipation structure according to an embodiment. The heat dissipation structure may be used in the cabinet light described above. The heat dissipation structure may include a heat dissipation shell 221 connected to a light emitting component; a sealing end cover 222 disposed on an open at one of two sides of the heat dissipation shell 221; and a heat dissipation partition 223 disposed in the heat dissipation shell 221. The heat dissipation shell 221 has opens at the top and two sides. The heat dissipation partition 223 is used to partition the heat dissipation shell 221 into a heat dissipation cavity 2212 and a lighting cavity 2211. The driving component 228 is installed in the heat dissipation partition 2212. The light emitting component 229 is installed in the lighting cavity 2211. A heat dissipation covering board 224 is disposed on the mouth of the heat dissipation cavity 2212. A light transmission element 225 is disposed on a mouth of the lighting cavity 2211 for light to pass through.

By placing the driving component 228 and the light emitting component 229 into two different cavities, the electrical protection can be improved. The heat dissipation partition 223 may prevent the heat generated by the driving component 228 from entering the lighting cavity 2211 and affecting the heat dissipation of the light emitting component 229. The heat dissipation cavity 2212 may increase the heat dissipation are of the lighting cavity 2211, and the heat generated from the lighting cavity 2211 may be quickly dissipated through the heat dissipation cavity 2212.

Figure 8:
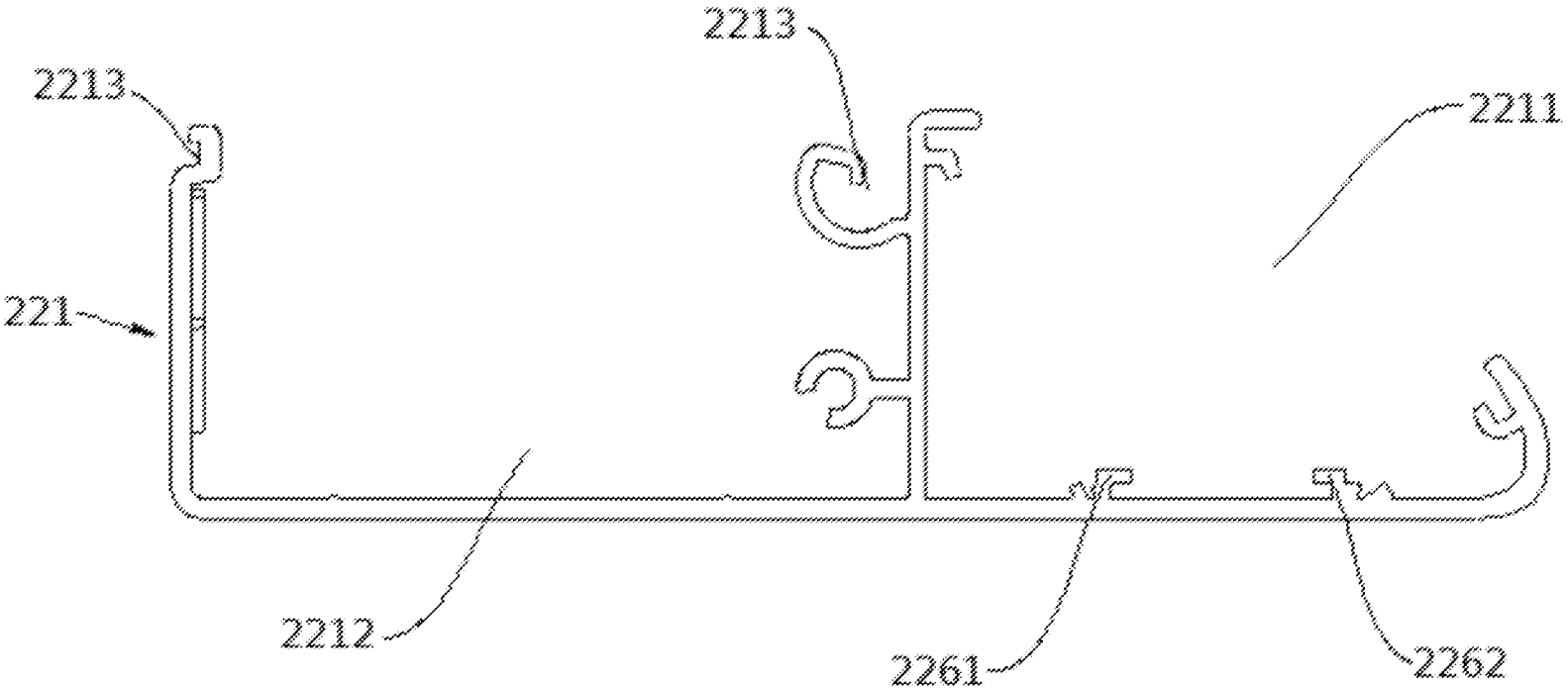

According to an embodiment, as shown in FIG. 6 to FIG. 8, at the bottom of the lighting cavity 11, a fixing unit 6 is disposed for installing the light emitting component 229. The fixing unit 6 may press and fix the light emitting component 229 for the light emitting component 229 to lean against the inner wall of the heat dissipation shell 221. The fixing unit 226 may press and fix the light emitting component 229 onto the heat dissipation shell 221 to improve the heat dissipation efficiency between the light emitting component 229 and the heat dissipation shell 221. The heat dissipation effect of the whole structure can be improved.

A heat conduction layer may be disposed between the light emitting component 229 and the heat dissipation shell 221. The light emitting component 229 may be PCB (printed circuit board) board with LED (light emitting diode) light bulb on it. When the light emitting component 229 is installed on the heat dissipation shell 221, the heat conductive layer may be disposed on a side wall of the heat dissipation shell 221, then the light emitting component 229 may be installed. The heat conduction layer may be formed using thermally conductive adhesive, also known as thermally conductive silica gel, thermally conductive RTV glue, and thermally conductive silicone rubber. It may be a paste-like gel that hardens in contact with the air and has high thermal conductivity and pasting properties. The heat conduction layer may also be a thermal conductive graphite sheet for heat conduction.

According to an embodiment, as shown in FIG. 7, the fixing unit 226 may include a first press strip 2261 disposed at the bottom of the lighting cavity 2211 for pressing the light emitting component 229; and the second press strip 2262 disposed at the bottom of the lighting cavity 2211. The first press strip 2261 and the second press strip 2262 can be arranged at interval and symmetrically. The first press strip 2261 and the second press strip 2262 may form a containing groove for placing the light emitting component 229. The light emitting component 229 can be inserted into the containing groove to be conveniently installed and be close to the inner wall of the heat dissipation shell 221.

According to an embodiment, each of the first press strip 2261 and the second press strip 2262 may be a strip structure having an L-shape cross section.

According to an embodiment, as shown in FIG. 8, the heat dissipation shell 221 may be generated using a metal material. The heat dissipation shell 221, the first press strip 2261 and the second press strip 2262 may be generated to be a one-pieced structure so as to improve the heat conduction. The first press strip 2261 and the second press strip 2262 may be disposed along a long side of the heat dissipation shell 221. The heat dissipation shell 221, the first press strip 2261 and the second press strip 2262 may be generated using an extrusion process. A part of the heat generated by the light emitting component 229 may be transmitted to the heat dissipation shell 221 via the first press strip 2261 and the second press strip 2262.

According to an embodiment, the first press strip 2261 and the second press strip 2262 may be inclined protruding strips of the heat dissipation shell 221 to be bending supports. The said bending supports can be disposed along a long side of the heat dissipation shell 221. There may be an angle between each of the bending supports and the inner wall of the heat dissipation shell 221. The bending directions of the two bending supports may be opposite to one another. The two bending supports may form the containing groove for placing the light emitting component 229, wherein the containing groove may have a trapezoidal shape.

As shown in FIG. 6 and FIG. 7, the heat dissipation covering board 224 may be slid to be snapped at the mouth of the heat dissipation cavity 2212. A side wall of the heat dissipation shell 221 (i.e. a side wall of the heat dissipation shell 221) and a side of the heat dissipation partition 223 may have fixing grooves 2213 for disposing the heat dissipation covering board 224. The number of the fixing grooves 2213 may be two according to an embodiment. The heat dissipation covering board 224 may seal the mouth of the heat dissipation cavity 2212 for better protecting the driving component 8 in the heat dissipation cavity 2212. The two sides of the heat dissipation covering board 224 may be close fixed on the heat dissipation shell 221 through the fixing grooves 2213, so the heat conduction may be improved between the heat dissipation covering board 224 and the heat dissipation shell 221. The heat dissipation covering board 224 may also increase the contact area of the heat dissipation cavity 2212 with the air.

According to an embodiment, as shown in FIG. 6 and FIG. 7, a plurality of heat dissipation ribs 2241 may be disposed at a side of the heat dissipation covering board 224 close to the heat dissipation cavity 2212. The heat dissipation ribs 2241 may be disposed along a long side of the heat dissipation covering board 224. The heat dissipation ribs 2241 may increase the surface area of the heat dissipation covering board 224 so as to increase the contact area with the air. The heat dissipation effect of the heat dissipation covering board 224 can be improved.

According to an embodiment, the heat dissipation shell 221 may be generated using a metal material such as (but not limited to) aluminum. Aluminum can be light weighted, high conductive, easily processed and of low cost.

As shown in FIG. 7 and FIG. 8, the heat dissipation partition 223 and the heat dissipation shell 221 may form a one-pieced structure. The heat dissipation partition 223 may be disposed along a long side of the heat dissipation shell 221. By means of the one-pieced structure, the heat conduction between the heat dissipation partition 223 and the heat dissipation shell 221 can be improved, and the contact area of the heat dissipation shell 221 with the air may be increased.

According to an embodiment, as shown in FIG. 6, a control switch 227 may be installed on the heat dissipation covering board 224 for controlling the light emitting component 229. The control switch 227, the light emitting component 229 and the driving component 228 may be electrically connected to one another. The control switch 227 may control the connection and disconnection among the control switch 227, the light emitting component 229 and the driving component 228. The control switch 227 may be used to conveniently control the light emitting component 229. The whole lamp can be used more conveniently.

According to an embodiment, an cabinet light may include one of the foresaid heat dissipation structures. By means of the abovementioned heat dissipation structure, the heat dissipation effect and the electrical protection of a cabinet light can be effectively improved.

In summary, by means of the cabinet light, the heat dissipation structure and the quick wiring structure disclosed by embodiments, the problem of the field can be effectively reduced.

The invention claimed is:

1. A cabinet light, comprising:

a heat dissipation shell;

a light emitting component disposed in the heat dissipation shell;

a driving component disposed in the heat dissipation shell and electrically connected to the light emitting component;

a sealing end cover disposed on an open at a side of the heat dissipation shell by insertion and comprising a cavity;

a cover element detachably disposed on an open at a top of the heat dissipation shell and comprising a light transmission area for light to pass through;

a fixing structure disposed between the sealing end cover and the cover element;

a piercing conductor disposed in the cavity and configured to pierce insulation layers of wires wherein the wires are placed in the cavity; and a press element disposed on a mouth of the cavity and configured to press the piercing conductor, wherein the piercing conductor comprises two side piercing elements and at least one middle piercing sheet disposed between the two side piercing elements, and the side piercing elements and the middle piercing sheet are fixed on the press element close to a side of the sealing end cover.

2. The cabinet light of claim 1, wherein the fixing structure comprises an installation bracket and a first lock element, the installation bracket is disposed at a side of the sealing end cover, the first lock element is disposed between the installation bracket and the cover element, and an installation surface is on the installation bracket for mounting the first lock element.

3. The cabinet light of claim 2, wherein the first lock element comprises:

a connection rod passing through the cover element and having a terminal detachably connected to the installation bracket; and a press cap connected to another terminal of the connection rod and configured to press and fix the cover element.

4. The cabinet light of claim 3, further comprising a support partition disposed in the heat dissipation shell and configured to partition the heat dissipation shell into a first cavity and a second cavity, wherein the driving component is disposed in the first cavity, and the light emitting component is disposed in the second cavity.

5. The cabinet light of claim 4, wherein a fixing groove is disposed on the support partition for fixing the sealing end cover, a second lock element is disposed on the sealing end cover, and the second lock element passes through the sealing end cover and is detachably inserted into the fixing groove.

6. The cabinet light of claim 5, wherein the support partition, the fixing groove and the heat dissipation shell are of an integrated structure.

7. The cabinet light of claim 4, wherein the cover element has a separable structure and comprises:

heat dissipation board disposed to cover a mouth of the first cavity; and a light transmission board disposed to cover a mouth of the second cavity wherein the light transmission area is on the light transmission board.

8. The cabinet light of claim 2, further comprising a support partition disposed in the heat dissipation shell and configured to partition the heat dissipation shell into a first cavity and a second cavity, wherein the driving component is disposed in the first cavity, and the light emitting component is disposed in the second cavity.

9. The cabinet light of claim 1, wherein the side piercing element comprises a piercing tip and an installation part, the piercing tip is disposed on the press element and configured to pierce the insulation layers of the wires, and the installation part is configured to fix the piercing tip on the press element close to a side of the sealing end cover.

10. The cabinet light of claim 9, wherein the installation part has an installation sheet, a wiring sheet and a connection sheet, the installation sheet is fixed and connected with the piercing tip, the wiring sheet is at a side of the installation sheet and configured to electrically connect the piercing element with the driving component, the connection sheet is disposed between the installation sheet and the wiring sheet, and the fixing structure is disposed on the wiring sheet for fixing the installation sheet on the press element.

11. The cabinet light of claim 10, further comprising a support partition disposed in the heat dissipation shell and configured to partition the heat dissipation shell into a first cavity and a second cavity, wherein the driving component is disposed in the first cavity, and the light emitting component is disposed in the second cavity.

12. The cabinet light of claim 9, further comprising a support partition disposed in the heat dissipation shell and configured to partition the heat dissipation shell into a first cavity and a second cavity, wherein the driving component is disposed in the first cavity, and the light emitting component is disposed in the second cavity.

13. The cabinet light of claim 1, further comprising a support partition disposed in the heat dissipation shell and configured to partition the heat dissipation shell into a first cavity and a second cavity, wherein the driving component is disposed in the first cavity, and the light emitting component is disposed in the second cavity.

14. The cabinet light of claim 1, further comprising a support partition disposed in the heat dissipation shell and configured to partition the heat dissipation shell into a first cavity and a second cavity, wherein the driving component is disposed in the first cavity, and the light emitting component is disposed in the second cavity.

* * * * *